US005209392A

United States Patent [19]

Anatro

[11] Patent Number: 5,209,392

[45] Date of Patent: May 11, 1993

[54] RECYCLABLE PIZZA BOX

[76] Inventor: Walter Anatro, 12 Shady La., Totowa, N.J. 07512

[21] Appl. No.: 932,213

[22] Filed: Aug. 19, 1992

[51] Int. Cl.[5] ..... B65D 5/36; B65D 5/42

[52] U.S. Cl. ..... 229/117.01; 229/117.05; 229/DIG. 4; 229/906

[58] Field of Search ..... 229/117.01, 117.05, 229/117.06, 145, 146, 152, 178, 402, 903, 906, 917, DIG. 2, DIG. 4; 426/113-115

[56] References Cited

U.S. PATENT DOCUMENTS

| | | | |
|---|---|---|---|
| D. 274,889 | 7/1984 | Sullivan . | |
| D. 292,176 | 10/1987 | Kuerti . | |
| 731,924 | 6/1903 | Lowy . | |
| 1,135,117 | 4/1915 | Lafore | 229/117.01 |
| 1,149,891 | 8/1915 | Billstein . | |
| 1,667,975 | 10/1924 | Labombarde . | |
| 2,109,716 | 3/1938 | Annen | 229/117.01 |
| 2,678,766 | 5/1954 | Leukoff | 229/906 |
| 3,014,633 | 12/1961 | Tarmina | 229/178 |
| 3,625,410 | 12/1971 | Hirschey | 229/117.01 |
| 3,642,193 | 2/1972 | Roda | 229/178 |
| 3,949,931 | 4/1976 | Hall . | |
| 4,232,816 | 11/1980 | Johnson et al. . | |
| 4,237,171 | 12/1980 | Laage et al. . | |
| 4,441,626 | 4/1984 | Hall | 229/178 |
| 4,476,989 | 10/1984 | Larsen . | |
| 4,798,323 | 1/1989 | Platt | 229/117.01 |
| 4,919,326 | 4/1990 | Deiger | 229/906 |
| 4,944,452 | 7/1990 | Kent et al. . | |
| 4,960,238 | 10/1990 | Lorenz . | |
| 5,014,853 | 5/1991 | Crockett | 229/906 |
| 5,110,038 | 5/1992 | Pantisano et al. | 229/906 |

*Primary Examiner*—Gary E. Elkins

*Attorney, Agent, or Firm*—Jacobson, Price, Holman & Stern

[57] ABSTRACT

A pizza box is formed of an upper panel and a lower panel which, by a series of fold lines is formed into a closable box. The upper panel includes a central, transversely extending score line. The lower panel also includes a centrally located, transversely extending score line. The score lines penetrate through the material forming the box. These score lines, as opposed to the fold lines which are formed in the blank to form a box, facilitate the collapse of the box, so that quarter portions of the collapsed box are stacked in an overlying condition. The reduced area of the collapsed box, formed into quarters, facilitates the storage of the box for recycling purposes.

4 Claims, 4 Drawing Sheets

RECYCLABLE PIZZA BOX

FIELD OF THE INVENTION

This invention relates to the field of recyclable paper products, particularly a recyclable pizza box.

BACKGROUND OF THE INVENTION

Various food containers, particularly cardboard pizza boxes, are known. Some examples of known pizza boxes are disclosed in U.S. Pat. No. 4,944,452 to Kent et al, U.S. Pat. No. 4,476,989 to Larsen, U.S. Pat. No. 4,960,238 to Lorenz, U.S. Design Pat. No. 292,176 to Kuerti, U.S. Design Pat. No. 274,889 tO Sullivan, U.S. Pat. No. 4,441,626 to Hall, U.S. Pat. No. 4,919,326 to Deiger and U.S. Pat. No. 4,237,171 to Laage et al. Other examples of paper formed boxes are disclosed in U.S. Pat. No. 1,667,975 to LaBombarde, U.S. Pat. No. 3,949,931 to Hall, U.S. Pat. No. 4,232,816 to Johnson et al, U.S. Pat. No. 1,149,891 to Billstein and U.S. Pat. No. 731,924 to Lowy.

The emphasis of all these patents is in the enclosing of a food or other product. There is no attention paid to the use of the packaging after being initially used.

However, it is becoming more and more important that all products that are recyclable, be recycled. A secondary use is thereby achieved by the manufacture of a new product made of recycled products.

It is presently a problem with known pizza boxes to provide a box that is easily collapsible and that occupies a minimum amount of space when collapsed. Due to the size of a formed pizza box, it is often difficult to dispose of the pizza box so that it is recycled for a secondary use. It is therefore customary to discard used pizza boxes without considering the possibility of recycling the pizza boxes due to the amount of space required to store a known pizza box.

SUMMARY OF THE INVENTION

By the present invention, a pizza box is formed of an upper panel and a lower panel which, by a series of fold lines is formed into a closable box. The upper panel includes a central, transversely extending score line. The lower panel also includes a centrally located, transversely extending score line. The score lines penetrate through the material forming the box.

These score lines, as opposed to the fold lines which are formed in the blank to form a box, facilitate the collapse of the box, so that quarter portions of the collapsed box are stacked in an overlying condition. The reduced area of the collapsed box, formed into quarters, facilitates the storage of the box for recycling purposes.

It is therefore an object of the present invention to provide a pizza box having at least one score line to facilitate collapsing of the box for recycling purposes.

It is yet another object of the present invention to provide a pizza box having at least one score line to facilitate collapsing of the box for recycling purposes with two score lines facilitating the folding of the box into quarters.

It is still yet another object of the present invention to provide a pizza box having at least one score line to facilitate collapsing of the box for recycling purposes with two score lines facilitating the folding of the box into quarters, one score line being located in an upper panel of the box and another score line being located in a lower panel of the box.

It is another object of the present invention to provide a pizza box having at least one score line to facilitate collapsing of the box for recycling purposes with two score lines facilitating the folding of the box into quarters, one score line being located in an upper panel of the box and another score line being located in a lower panel of the box, with the score lines being centrally located in a respective panel of the box.

It is therefore an object of the present invention to provide a recyclable pizza box having score lines on an upper panel and on a lower panel so that the box may be folded into quarters for recycling purposes.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
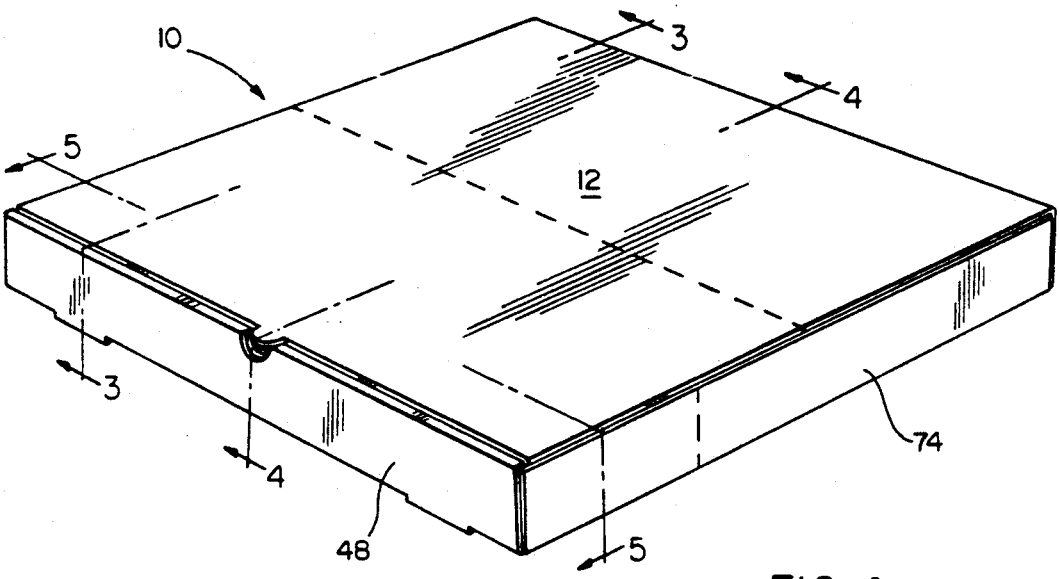
FIG. 1 is a perspective view of a closed pizza box.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
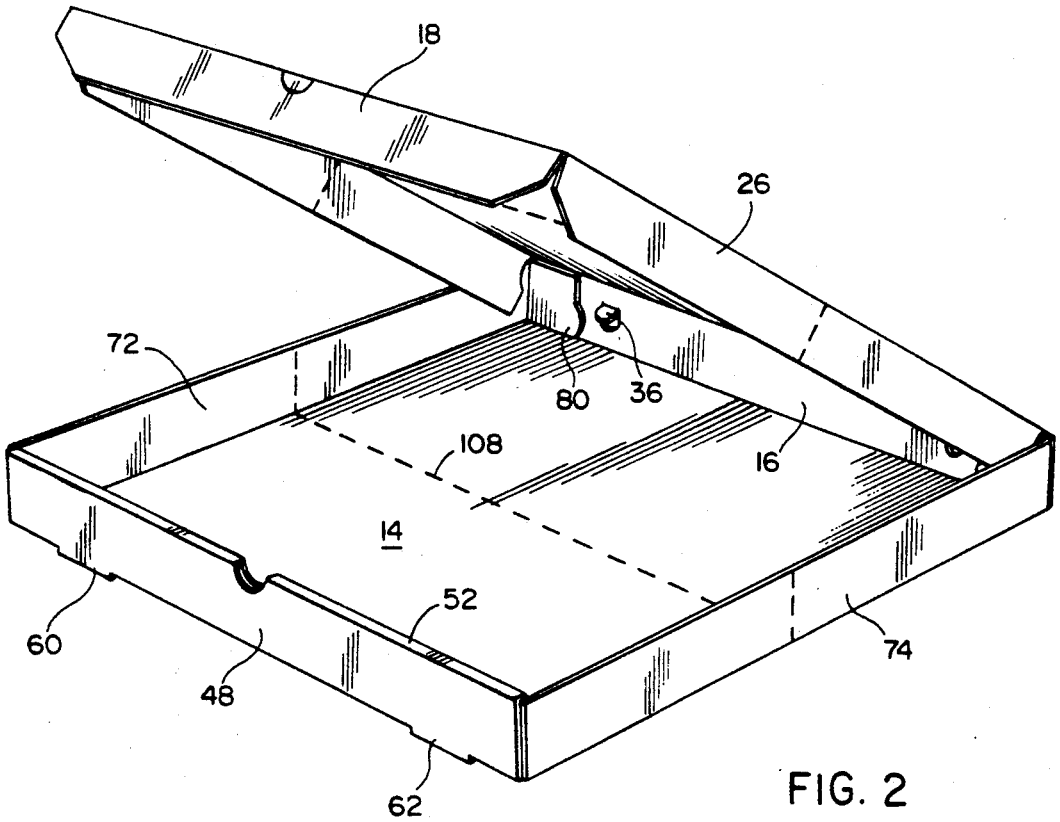
FIG. 2 illustrates the pizza box of FIG. 1 in an open position.

With reference to the drawings, in general, and to FIGS. 1 and 2, in particular, a pizza box embodying the teachings of the subject invention is generally designated as 10. With reference to its orientation in FIG. 6, the pizza box includes a blank 11 having an upper panel 12 and a lower panel 14. Interconnecting the upper and lower panels in a rear side panel 16.

The upper panel 12 includes a front closure flap 18 connected to the upper panel 12 by fold line 20. A semicircular tab 22 is cut from front closure flap 18 and is used in securing the assembled pizza box in a closed position. The tab 22 is also secured to the upper panel 12 by fold line 20. On opposite sides of the upper panel 12 are upper side panels 24 and 26 connected to the upper panel 12 by fold lines 28, 30, respectively.

The upper panel 12 is connected to the rear side panel 16 by fold line 32. In the rear side panel 16, are two ventilation flaps 36, 38 which are cut from the rear side panel 16 and connected to the rear side panel by fold lines 40, 42, respectively.

Extending transversely across the upper panel 12 and centrally located within the panel 12 is score line 34 which, in contrast to the fold lines of the pizza box blank 11, penetrates through the upper panel 12 to facilitate a lay flat folding of upper panel portion 12A over upper panel portion 12B.

Lower panel 14 is connected by fold line 44 with front side panel 46. Front side panel 46 includes two panel portions 48, 50. Extending between panel portions 48 and 50 is a panel strip 52. Panel strip 52 is connected to panel portions 48, 50 by fold lines 54, 56, respectively. Extending across panel portions 48, 50 and panel strip 52 is an oblong cut-out opening 58 which cooperates with tab 22.

Panel portion 48 includes cut-out projections 60, 62, defined by cut lines 64, 66, respectively. Extending opposed to the projections 60, 62, from panel portion 50 are tabs 68, 70 which cooperate with the cut lines 64, 66 when assembling the front side panel 46.

Extending from opposite sides of lower panel 14 are lower side walls 72, 74. The lower side walls are connected to lower panel 14 by fold lines 76, 78, respectively. Projecting laterally from each lower side wall 72, 74 are stabilizer panel portions 80, 82, which are connected to lower side walls 72, 74 by fold lines 84, 86, respectively. At an opposite end of lower side walls 72, 74 are stabilizer panel portions 88, 90 connected to the lower side walls 72, 74 by fold lines 92, 94, respectively.

In the forming of the pizza box blank 11, the stabilizer panel portions 88, 90 are separated from the front side panel 46 by cut lines 96, 98, respectively. The configuration of cut lines 96, 98 is such that a portion 100, 102 of cut line 96 extends above and has a greater width than the remaining portion 104, 106 of cut lines 96, 98. This configuration of the cut lines 96, 98, cooperates with the assembly of the front side panel 46, as will be explained in greater detail with reference to the remaining figures.

Extending centrally and transversely across lower panel 14 is score line 108 which penetrates through lower panel 14 to divide lower panel 14 into lower panel portions 14A and 14B. The lower panel portions overlie each other in a flat parallel position when folded on top of one another.

In the assembled condition of the pizza box blank 11, as shown in FIGS. 1 and 2, the panel portion 50 is folded 180° inwardly along fold line 5 and panel portion 48 is then folded 90° with panel portion 50 to a vertical position along fold line 44 so that panel portion 50 extends parallel to panel portion 48 and panel portions 48 and 50 are spaced apart from each other by panel strip 52.

Figure 3:
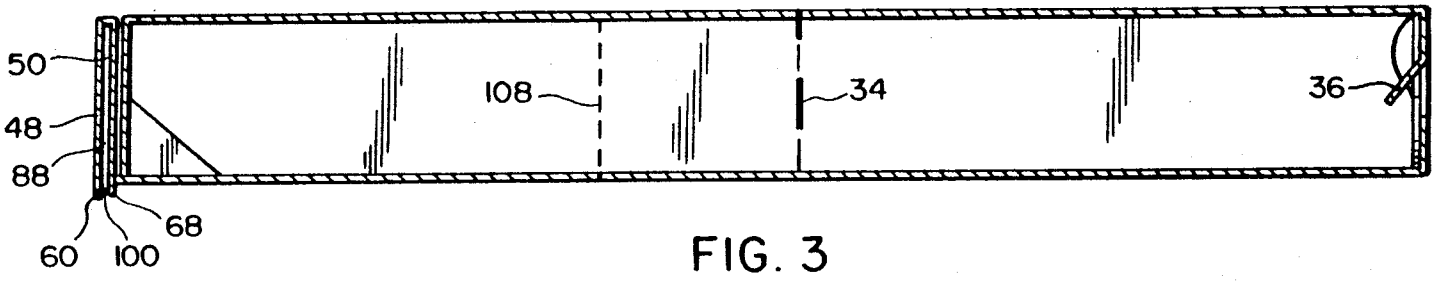
FIG. 3 is a sectional view taken along line 3—3 of FIG. 1.
Figure 4:
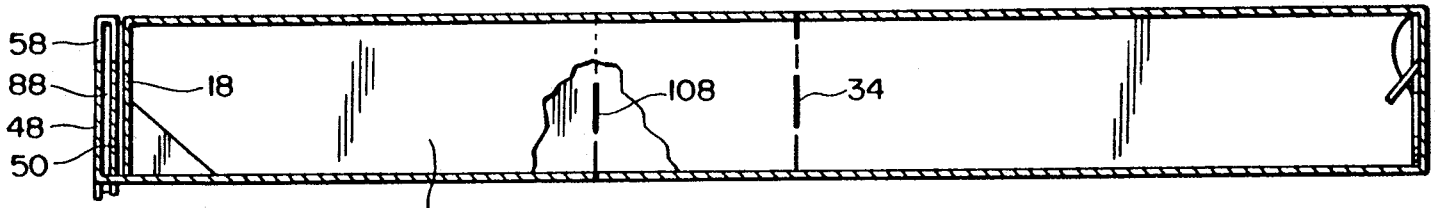
FIG. 4 is a sectional view taken along line 4—4 of FIG. 1.
Figure 5:
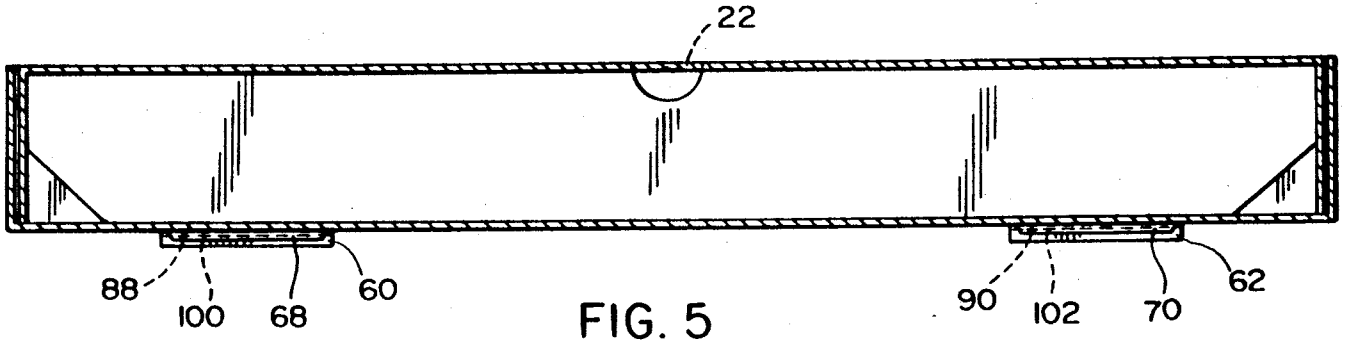
FIG. 5 is a sectional view taken along line 5—5 of FIG. 1.

Prior to the forming of the front side panel 46 from panel portions 48, 50, side panels 72 and 74 are folded inwardly 90° along fold lines 76 and 78, respectively. Similarly, stabilizer panel portions 80 and 82 are then folded inwardly 90° to align stabilizer panel portions 80, 82 against rear side panel 16 which has also been folded inwardly 90° along fold line 31. Opposite stabilizer panel portions 88 and 90 are also folded 90° such that the cut line portions 100, 102 extend through a slot formed by cut line 64 and 66 to have stabilizer panel portions 88, 90 be aligned parallel with panel portions 48, 50 as shown in FIGS. 3 and 4.

When the pizza box is assembled as shown in FIG. 2, the upper panel 12 is foldable to a position parallel to bottom panel 14 by folding of the upper panel 12 along fold line 32. The upper panel is also pivotable about fold line 32 to a position for gaining access to the interior of the assembled pizza box. For storage of a product, the upper panel 12 is positioned in the position shown in FIG. 1 with the tab 22 extending within the opening 58 to secure the upper panel 12 in place.

Figure 6:
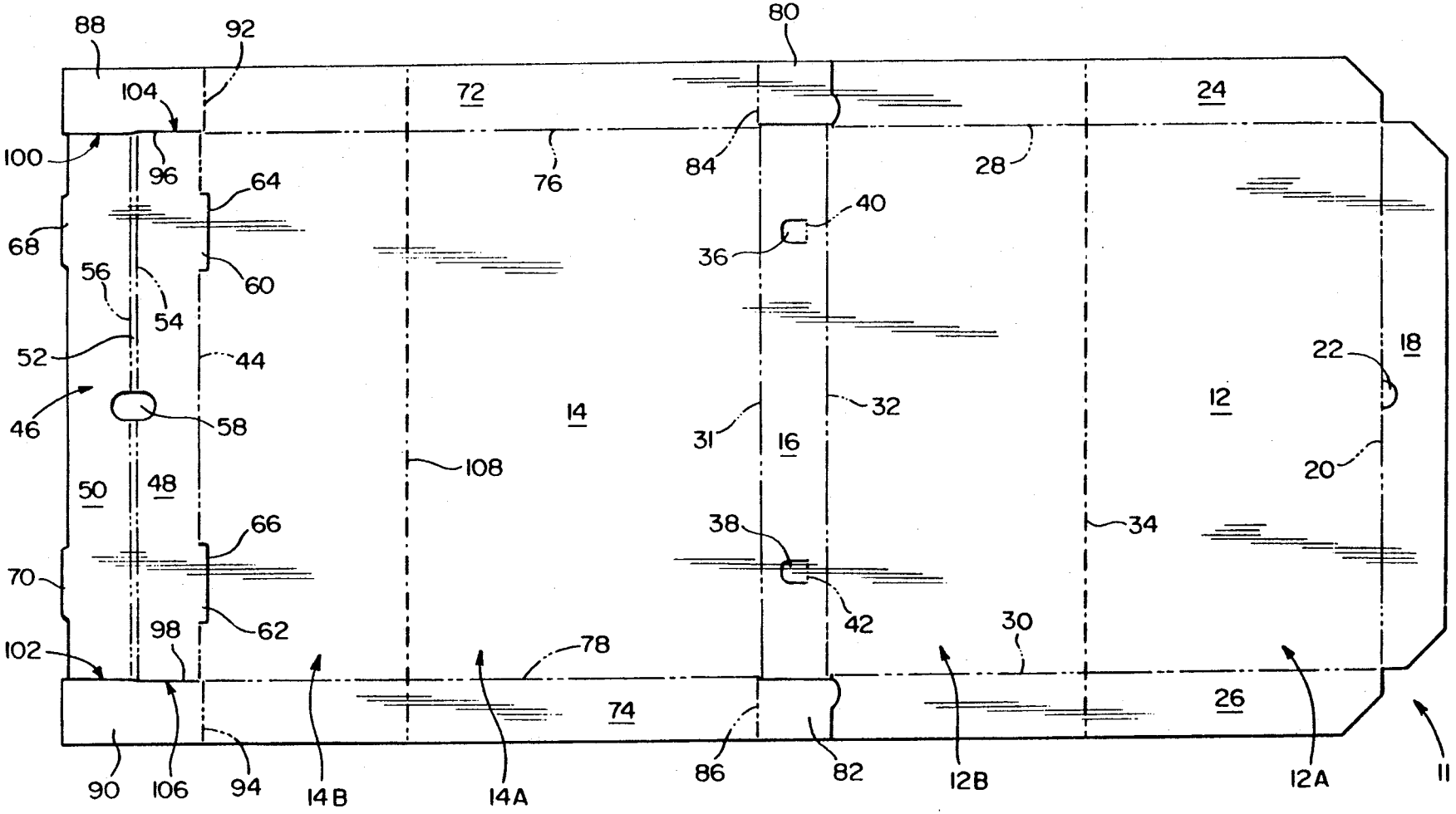
FIG. 6 illustrates an unfolded view of a pizza box blank.
Figure 7:
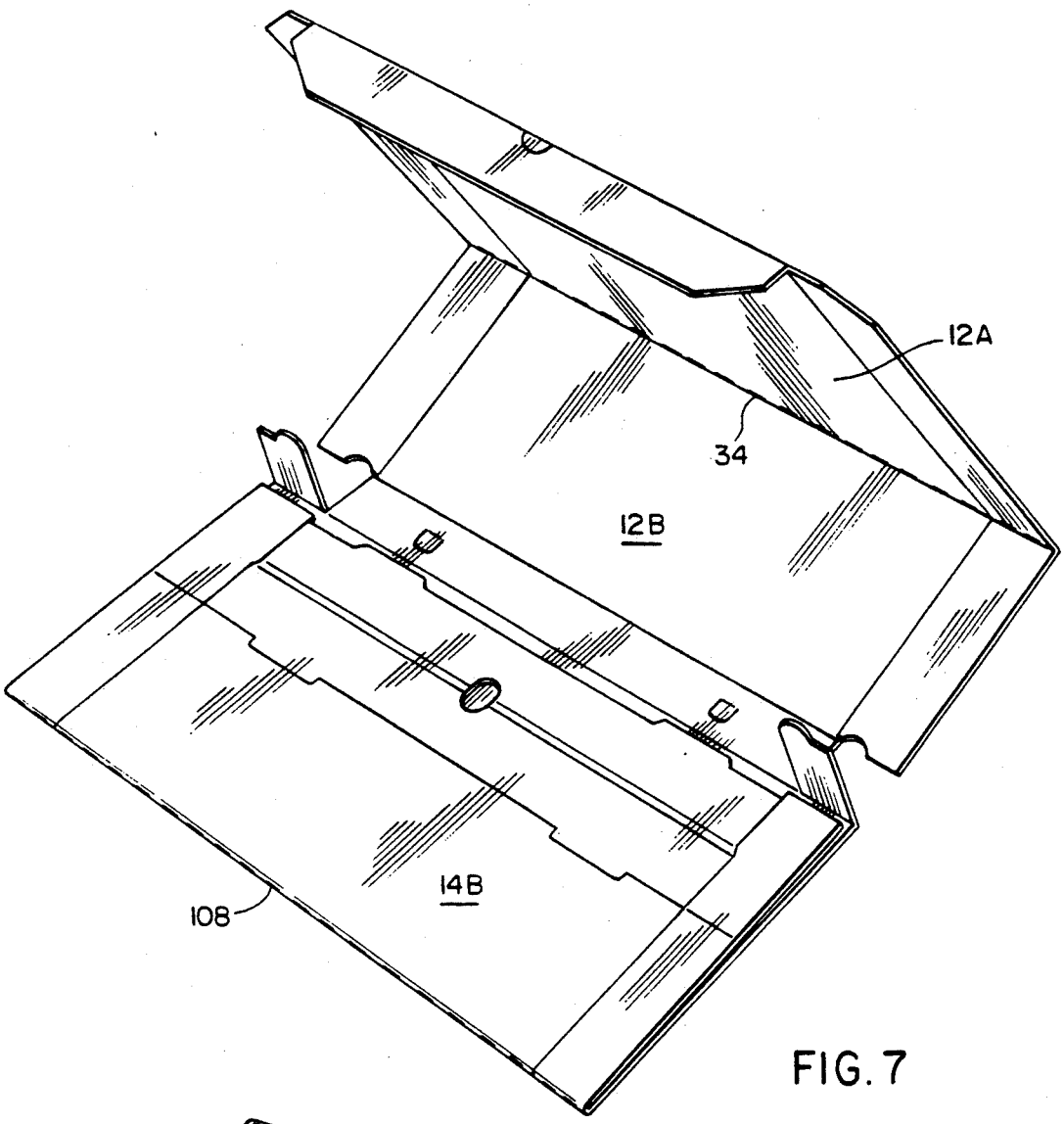
FIG. 7 illustrates the collapsing of a pizza box blank into quarters.

When the use of the pizza box is completed, the pizza box is unfolded from the condition shown in FIG. 1 to a lay flat position as shown in FIG. 6. Then, as shown in FIG. 7, the lower panel 14 is creased along score line 108 so that the lower panel sections 14A and 14B lie on top of each other and extend parallel to each other, as shown in FIG. 7. Similarly, upper panel sections 12A and 12B are moved towards each other about score line 34 so as to move the upper panel portions 12A and 12B to extend parallel to each other, one on top of the other.

Figure 8:
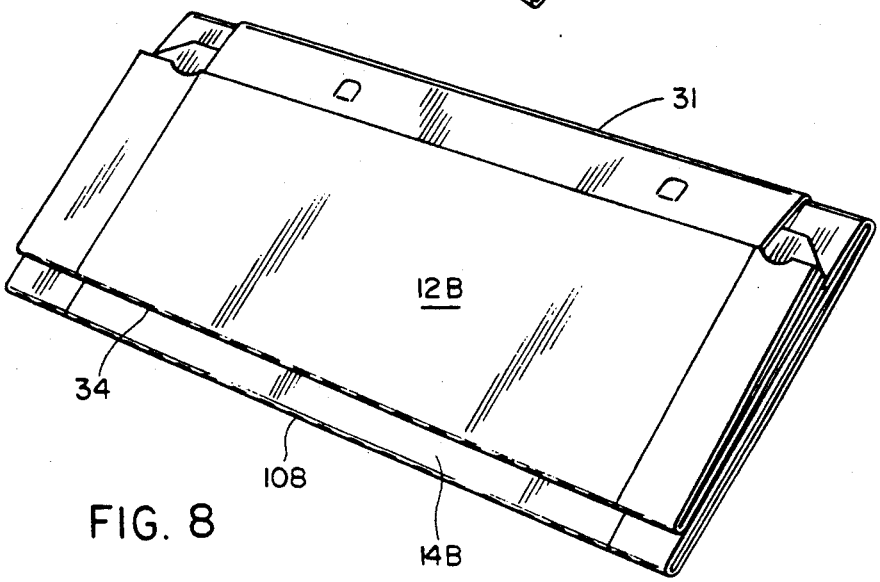
FIG. 8 illustrates a collapsed pizza box.

Then the collapsed portions 14A and 14B are moved about fold line 31 so that the two upper panel sections 12A and 12B overlie the two lower panel sections 14A, 14B, as shown in FIG. 8. In this position, a minimum amount of space is utilized for storage of the collapsed pizza box prior to its being recycled.

Having described the invention, many modifications thereto will become apparent to those skilled in the art to which it pertains without deviation from the spirit of the invention as defined by the scope of the appended claims.

I claim:

1. A box comprising:

an upper panel including a rear side wall, a lower panel, a fold line connecting said rear side wall to said lower panel, a first score line extending across said upper panel substantially parallel to said fold line, a second score line extending across said lower panel substantially parallel to said fold line, said upper panel being collapsible along said first score line into two overlying, parallel extending portions, said lower panel being collapsible along said second score line into two overlying, parallel extending portions, said upper panel and said lower panel being folded along said fold line so that said two portions of said upper panel and said two portions of said lower panel overlie each other in a stacked arrangement for recycling purposes while minimizing required storage area.

2. A box according to claim 1, wherein said first score line of said upper panel is centrally located.

3. A box according to claim 2, wherein said second score line of said lower panel is centrally located.

4. A box according to claim 1, further comprising two opposed side walls forming part of said lower panel and a front side panel forming part of said lower panel, said front side panel including two panel portions extending parallel to each other with a portion of said two opposed side walls extending between said two panel portions of said front side panel with said portion of said two opposed side walls extending through a slot defined between said lower panel and said front side panel.

* * * * *